US005406748A

United States Patent [19]

Davlantes

[11] Patent Number: 5,406,748

[45] Date of Patent: Apr. 18, 1995

[54] VERTICALLY MOVABLE PET DOOR FLAP

[76] Inventor: George N. Davlantes, 21457 Iglesia Dr., Woodland Hills, Calif. 91364

[21] Appl. No.: 224,755

[22] Filed: Apr. 8, 1994

[51] Int. Cl.[6] ..... E05D 15/48

[52] U.S. Cl. ..... 49/169; 49/245; 49/394

[58] Field of Search ..... 49/169, 168, 171, 208, 49/380, 394, 236, 240, 245; 160/180

[56] References Cited

U.S. PATENT DOCUMENTS

| | | | |
|---|---|---|---|
| 326,914 | 6/1892 | Kirk | D25/48 |
| 334,431 | 3/1893 | Davlantes | D25/60 |
| 334,809 | 4/1893 | Davlantes | D25/48 |
| 334,810 | 4/1893 | Davlantes | D25/60 |
| 3,985,174 | 10/1976 | Bricker | 160/180 |
| 4,047,331 | 9/1977 | Davlantes | 49/171 |
| 4,216,743 | 8/1980 | Cohen | 49/171 X |
| 4,347,502 | 8/1982 | Holmes et al. | 340/545 |
| 4,408,416 | 10/1983 | Davlantes | 49/168 |
| 4,480,407 | 11/1984 | Needham et al. | 49/168 |
| 4,651,793 | 3/1987 | Davlantes | 160/92 |
| 4,754,797 | 7/1988 | Sronce | 160/354 |
| 4,760,872 | 8/1988 | Hales, Jr. | 160/90 |
| 4,776,133 | 10/1988 | Green | 49/394 |
| 4,840,217 | 6/1989 | Evans, III | 160/368.1 |
| 4,908,987 | 3/1990 | Dickson et al. | 49/169 |
| 4,938,169 | 7/1990 | Barmakian | 119/83 |
| 4,947,606 | 8/1990 | La See | 49/171 X |
| 4,953,500 | 9/1990 | Savage-Rumbaugh et al. | 119/17 |
| 4,969,292 | 11/1990 | Reid et al. | 49/169 |
| 4,991,350 | 2/1991 | Kirk | 49/169 |
| 4,995,336 | 2/1991 | Deemer et al. | 119/15 |
| 5,072,544 | 12/1991 | Breck, Jr. | 59/264 |
| 5,117,890 | 6/1992 | Taylor et al. | 160/180 |
| 5,185,954 | 2/1993 | Waddle, Sr. | 49/168 |
| 5,287,654 | 2/1994 | Davlantes | 49/169 |

FOREIGN PATENT DOCUMENTS 2223049 3/1990 United Kingdom .

*Primary Examiner*—Philip C. Kannan

*Attorney, Agent, or Firm*—Lahive & Cockfield

[57] ABSTRACT

A pet door apparatus that allows an animal to enter and exit an enclosure. The pet door includes a frame element defining an opening in the enclosure that has a top frame portion, and a flap element that closes the opening. The flap element has a top portion and extends, in a first orientation, substantially vertically downward from the top portion. The flap top portion includes a horizontally extending pivot element for pivotably moving the flap in response to an applied horizontal force. The flap top portion includes a camming element that vertically moves the top frame portion relative to the frame top portion during pivotal movement of the flap away from the generally vertical position. The opening defined by the frame element has a wider top that tapers to a narrower bottom. The flap is correspondingly tapered to seat within the frame element. The pet door further includes a locking element for preventing the flap from moving in a selected direction substantially transverse to the flap, when the flap is disposed in the first orientation. The locking element preferably includes an exit locking element for preventing movement of the flap in a first direction, thereby allowing an animal to exit the enclosure through the door, and an enter locking element, independent of the exit locking element, for preventing movement of the flap in a second direction opposite the first direction, thereby allowing an animal to enter the enclosure through the door. The exit locking element and the enter locking element include a locking lever and a locking plate. The locking lever includes a main body having a handle portion integrally formed at a first end, and a chamfered second end. The locking plate has an eccentric chamfered through bore that is substantially complementary in configuration to the locking lever second end, and is movable between a locked position and an unlocked position by rotating the locking lever in a predetermined direction.

11 Claims, 9 Drawing Sheets

VERTICALLY MOVABLE PET DOOR FLAP

BACKGROUND

The present invention relates generally to the field of pet doors. More particularly, this invention relates to pet doors having movable flaps that provide a substantially weathertight seal.

Prior art pet doors exist for providing pet animals exit from or entrance into an enclosure, e.g., a house. These doors typically consist of a frame having sidewalls defining an opening, and a movable flap. The flap, generally having dimensions larger than the opening formed by the pet door frame, is composed of a resilient material that conforms to the frame contours, thus providing a weathertight seal. The flap is typically aligned with the frame by a variety of mechanical means. One prior art method of ensuring that a good seal exists between the flap and the frame, is to provide a flap having wipers along the flap's vertical edge, as disclosed in U.S. Pat. No. 4,047,331, by the present inventor. The wipers help seal the flap against the edges of the frame sidewall.

Another prior art pet door that provides a weathertight seal is disclosed in U.S. Pat. No. 4,651,793, also by the present inventor. This pet door provides a frame that supports a resilient flap that mounts magnets along a bottom edge. The frame includes a movable bottom sill that also mount magnets at locations substantially complementary to the flap-mounted magnets. The flap and sill magnets cooperate to seat the flap within the frame, thereby providing a substantially weathertight seal.

A goal of these and other prior art pet doors is ensuring that a good seal exists between the edges of the flap and the frame during repeated use of the doors. There still exists a need in the art for an improved pet door that provides a flap that forms a substantially weathertight seal between the flap and the frame. Accordingly, it is an object of the present invention to provide a pet door having improved sealing capabilities.

It is another object of the invention to provide a pet door that has a flap that sufficiently seats within the frame.

Yet another object of the invention is to provide a pet door that is relatively low-cost and relatively easy to manufacture.

Other general and more specific objects of the invention will in part be obvious and in part be evident from the drawings and description which follow.

SUMMARY OF THE INVENTION

These and other objects are attained by the present invention which provides, in one aspect, a pet door apparatus that allows an animal to enter and exit an enclosure. The pet door includes a frame element defining an opening in the enclosure that has a top frame portion, and a flap element that closes the opening. The flap element has a top portion and extends, in a first orientation, substantially vertically downward from the top frame portion. The flap top portion includes a horizontally extending pivot element for pivotably moving the flap in response to an applied horizontal force. In a preferred embodiment of the invention, either the top frame portion or the flap top portion includes a camming element that vertically moves the top frame portion relative to the frame top portion during pivotal movement of the flap away from the generally vertical position.

According to another aspect of the invention, the opening defined by the frame element has a wider top that tapers to a narrower bottom. The flap is correspondingly tapered to seat within the frame element.

According to another aspect of the invention, the pet door includes a locking element for preventing movement of the flap in a selected direction substantially transverse to the flap, from the first orientation of the flap. The locking element preferably includes an exit locking element for preventing movement of the flap in a first direction, thereby preventing an animal from exiting the enclosure through the door, and an enter locking element, independent of the exit locking element, for preventing movement of the flap in a second direction opposite the first direction, thereby preventing the animal from entering the enclosure through the door. The exit locking element and the enter locking element preferably include a locking lever and a locking plate. The locking lever includes a main body having a handle portion integrally formed at a first end, and a chamfered second end. The locking plate preferably has an eccentric chamfered through bore that is substantially complementary in configuration to the locking lever second end, and is movable between a locked position and an unlocked position by rotating the locking lever in a predetermined direction.

Further aspects of the invention can be determined from the above summary and from the description which follows.

BRIEF DESCRIPTION OF THE DRAWINGS

The foregoing and other objects, features and advantages of the invention will be apparent from the following description of a preferred embodiment of the invention illustrated in the accompanying drawings, in which like characters rotor to the same parts throughout the different views. The drawings illustrate principles of the invention and, although not to scale, show relative dimensions.

DESCRIPTION OF ILLUSTRATED EMBODIMENT

Figure 1:
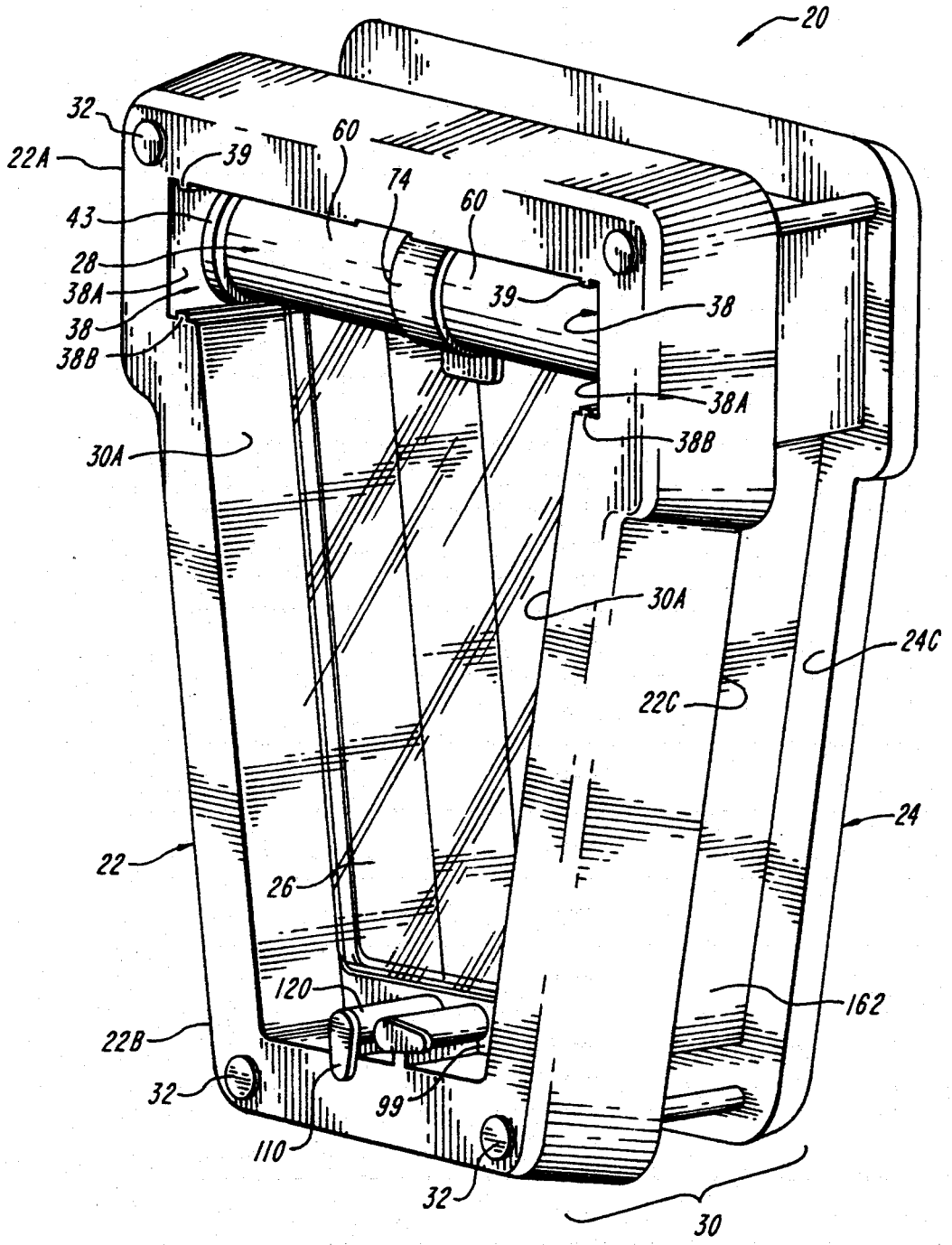
FIG. 1 is a perspective view of a pet door according to a preferred embodiment of the invention.
Figure 2:
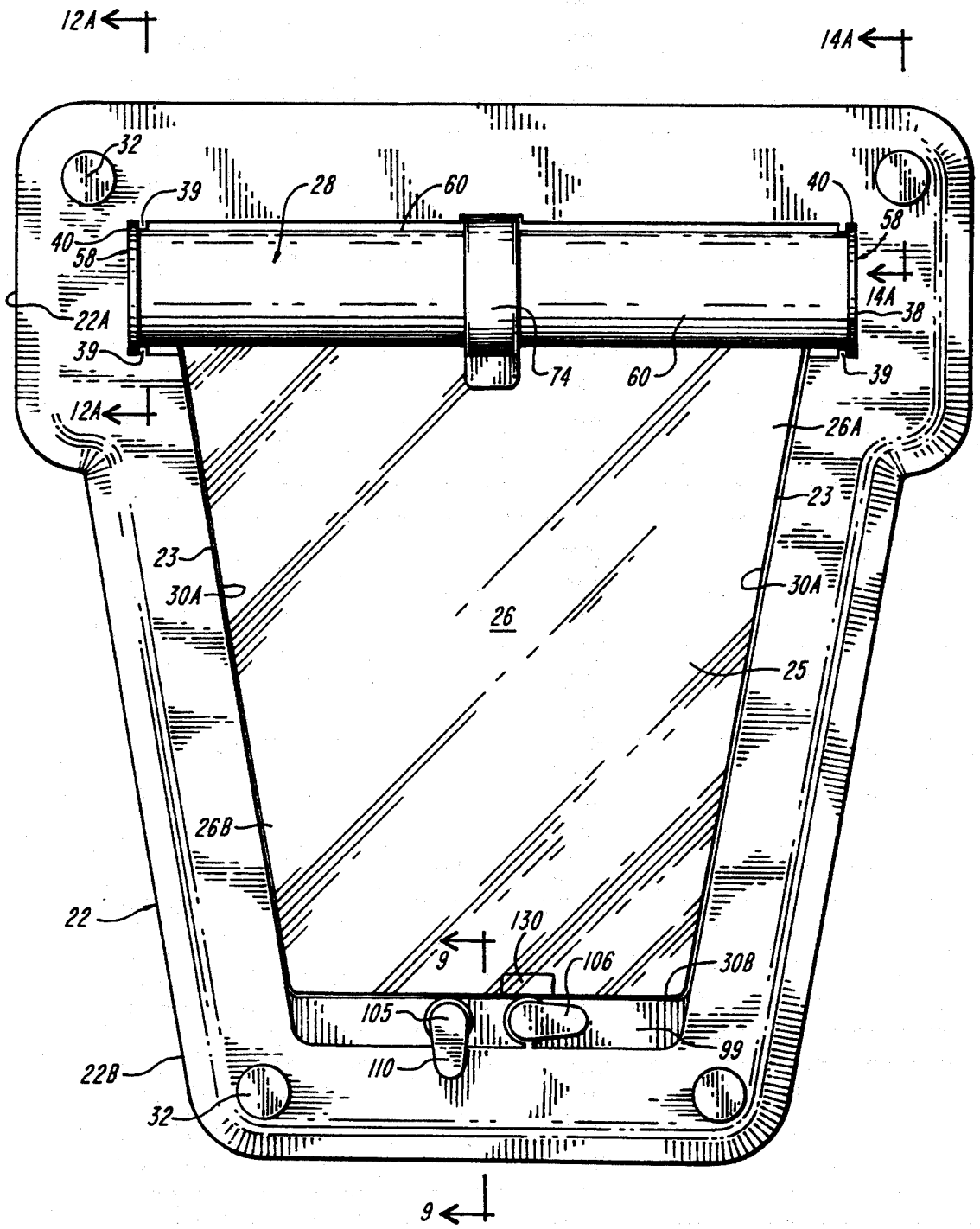
FIG. 2 is a front view of the pet door of FIG. 1.
Figure 3:
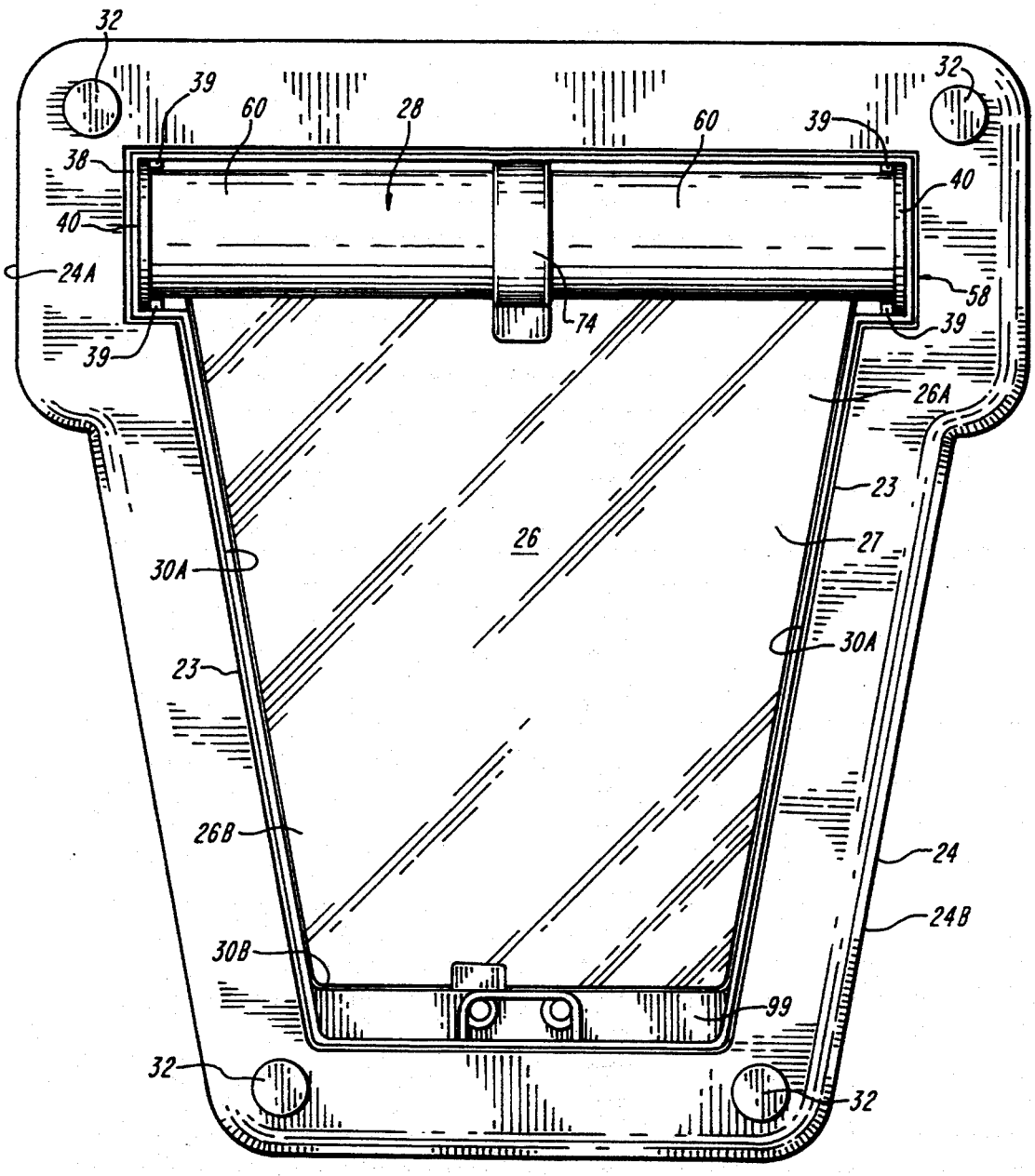
FIG. 3 is a rear view of the pet door of FIG. 1.

As shown in FIGS. 1-3, the pet door 20 of the present invention includes a frame assembly 30 having a front frame member 22, a rear frame member 24, and a door flap 26. The door flap 26 is mountingly supported within the frame assembly 30 by a flap top portion assembly 28 (FIG. 4), as described in greater detail below. As illustrated, when the flap 26 is disposed in its normally vertically extending position, the flap 26 sealing mates with the side 30A,30A and bottom 30B portions of the interior of the frame assembly 30. The frame assembly 30 is configured to seat within an opening formed in an enclosure, such as a door or wall of a house. The frame members 22 and 24 telescopically move relative to each other, thereby increasing the overall width of the pet door 20. This feature allows the door to retrofit in doors and walls of various thicknesses. The frame members 22,24 are secured to each other by fasteners (FIGS. 14A and 14B) that are depressed within fastener-receiving apertures formed in the frame members 22,24. The apertures and fasteners are hidden from view by screw caps 32 that seat within the fastener receiving apertures.

It is a significant feature of the present invention that when the flap 26 is biased away/? ore its normally vertical position, such as by a pet animal, the flap top portion 28 moves vertically relative to the stationary frame assembly 30. This vertical movement of the flap top portion 28 properly seats and unseats the tapered flap 26, without employing extraneous mechanical capturing mechanisms (i.e., magnets or oversized flaps). By way of example, when the flap is displaced from the normally vertical position, the vertical movement of the flap top portion 28 unseats the flap 26 and allows it to move pivotally outward. Conversely, when the flap is released from this displaced position, the frame top portion 28 moves vertically downward, and the tapered inner surface of the frame assembly 30 seats the tapered flap 26 in its original vertical position, thereby re-forming the weather-tight seal.

As best shown in FIGS. 2 and 3, the front and rear frame members 22 and 24 have a wider top portion 22A.24A and a narrower bottom portion 22B and 24B. The frame members 22 and 24 further have a tapered inner surface 23 forming a substantially wedge-like shape. The frame inner surface has a pair of mounting grooves 38 formed along a top portion 58 of the frame inner surface 23 that are adapted to receive a stationary cam element 40. The mounting groove 38 includes a pair of guide rails 39 that help seat the cam element 40 in the groove 38, while placing the cam element 40 in intimate facing contact with a back wall 38A and a sidewall 38B of the groove.

Figure 4:
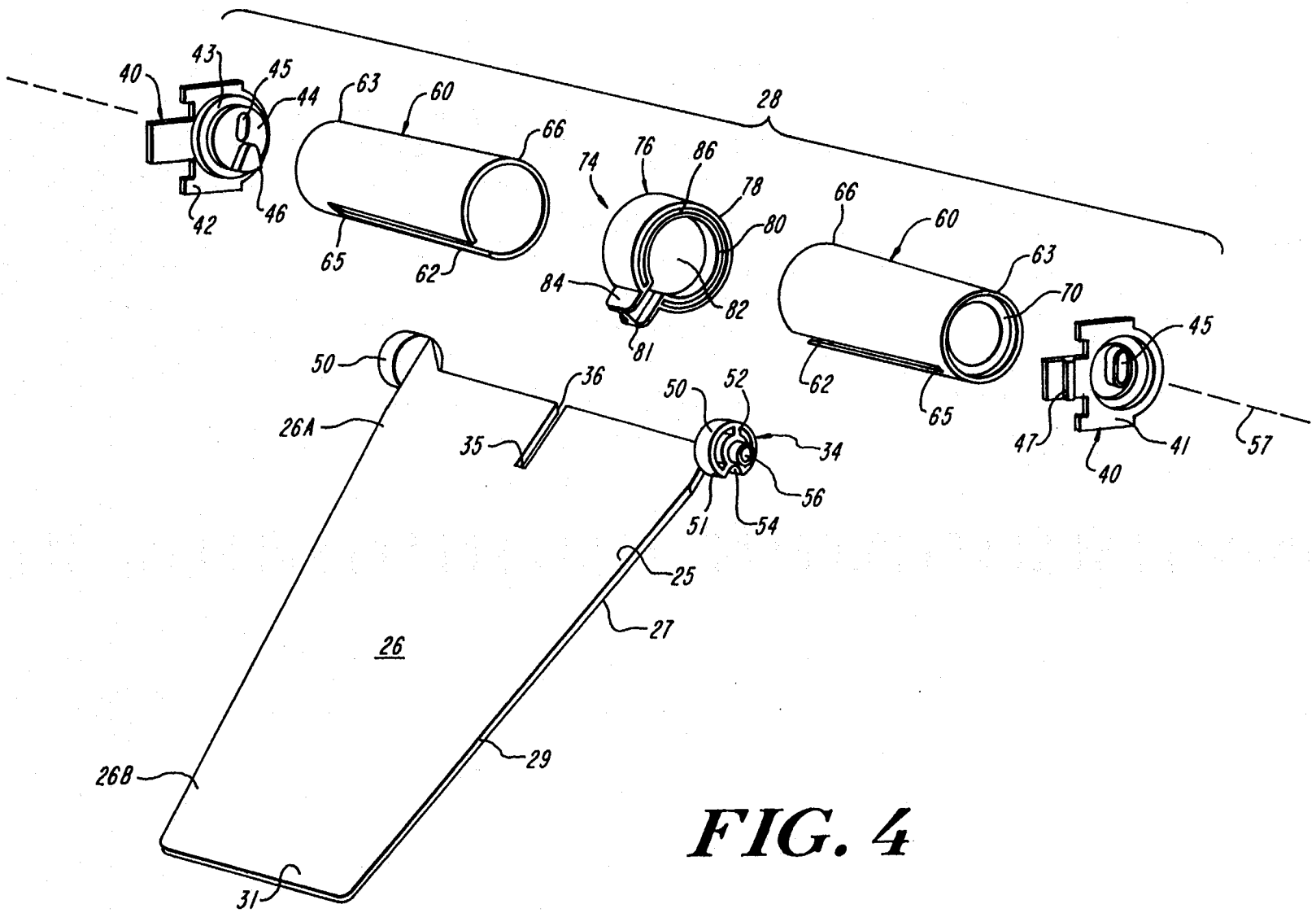
FIG. 4 is an elevational exploded view of the flap and cam assembly according to a preferred embodiment of the invention.

The flap 26 and the flap top portion assembly 28 are depicted in FIGS. 4 through 8. The flap 26 has a generally wedge-like shape that preferably has a wider top portion 26A and a narrower bottom portion 26B. A pair of follower elements 34,34 are integrally formed at the top 26A of the flap 26. The flap top 26A also has formed thereon a longitudinally extending groove 36 that mates with a receiving portion of a retaining clip 74, for fixedly securing the flap 26 to the flap top portion assembly 28 (see FIGS. 1 and 4). As best shown in FIG. 4, the follower element 34 has a peripheral surface 50 that has an inwardly extending wedge-shaped groove 54 formed along a bottom portion 51. The angle formed by the groove 54 relative to its apex 102 is preferably in the range of about 40° to about 70°, and most preferably about 60°. A side face 52 of the follower element 34 has an integrally formed and outwardly extending cylindrical protrusion 56. Although the groove 54 is depicted as wedge-shaped, those of ordinary skill will recognize that any number of suitable geometric shapes can be used.

Figure 5:
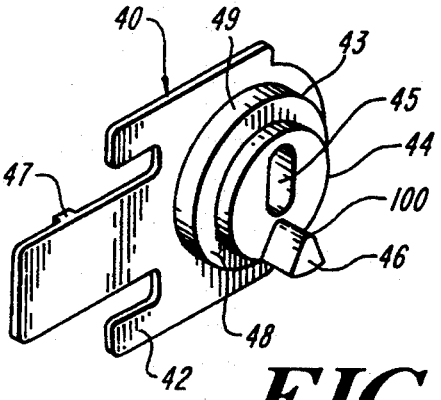
FIG. 5 is an exploded view of the stationary member of FIG. 4.

The stationary cam element 40 has a front face 42 that includes a pair of concentric, stepped circular surfaces 43 and 44, as best shown in FIG. 5. The upper stepped surface 44 has formed at one end an eccentric and elliptically shaped through bore 45. An eccentric wedge-shaped protrusion 46, disposed beneath the through bore 45, extends axially outward from the stepped surface 44. The rear surface 41 of the stationary cam 40 preferably has a longitudinal stop tab 47 formed thereon (FIG. 4). The stop tab 47 abuts a complementary tab formed along the inner wall of the mounting groove 38 (not shown), seating the stationary cam in its proper position. The angle formed by the wedge-shaped protrusion 46, as measured from the wedge apex 100, is preferably in the range of about 40° to about 70°, and most preferably about 60°. Although depicted as wedge-shaped, those of ordinary skill will recognize that the protrusion 46 can assume any mechanically suitable geometric shape. However, the protrusion 46 is preferably complementary in shape to that of the follower element groove 54. As shown in FIG. 1, the stationary cam element 40 seats in the mounting groove 38.

Figure 6:
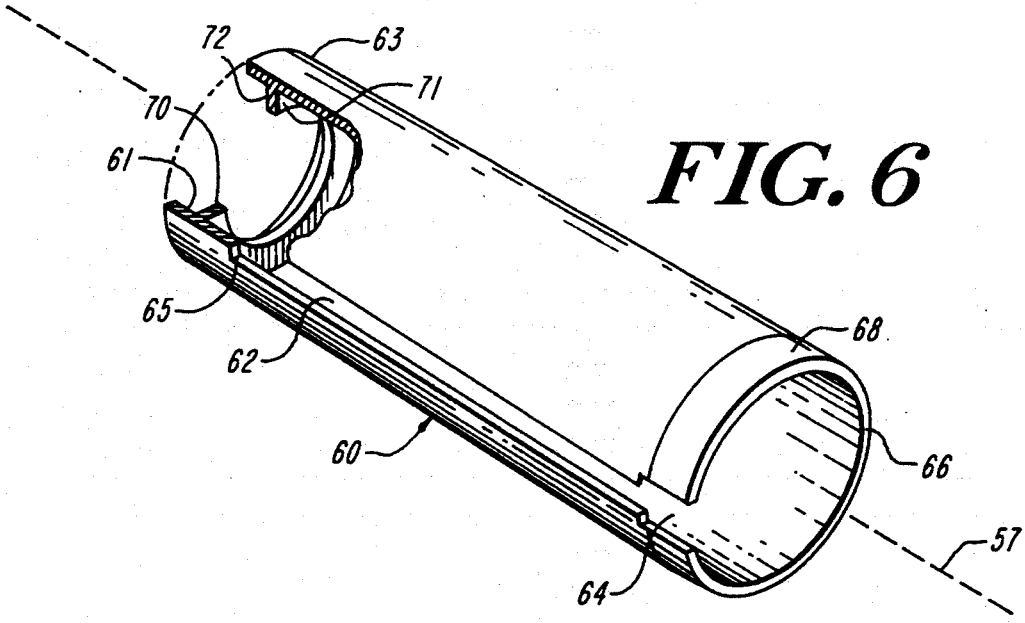
FIG. 6 is a partially cut away perspective view of the flap holder according to a preferred embodiment of the invention.

The flap top assembly 28 includes a pair of tubular sleeves 60,60 that extend along an axis 57. The sleeve 60 has an axially extending groove 62 formed along a substantial portion of the sleeve 60, opening onto a slot 64 formed at an inner end 66 of the sleeve, as shown in FIGS. 4 and 6. The inner end 66 also includes an integrally formed collar 68. In a preferred embodiment, the outer diameter of the collar 68 is close to or equal to the outer diameter of the sleeve 60. However, the collar outer diameter can also be less than the outer diameter of the sleeve 60, thereby forming in conjunction with the retainer clip 74, a relatively smooth transitional surface between the two sleeves 60. A radially inwardly extending annular flange 70, having a rear surface 71 and a front surface 72, is integrally formed along an inner wall 61 of the sleeve outer end 63.

Figure 7A:
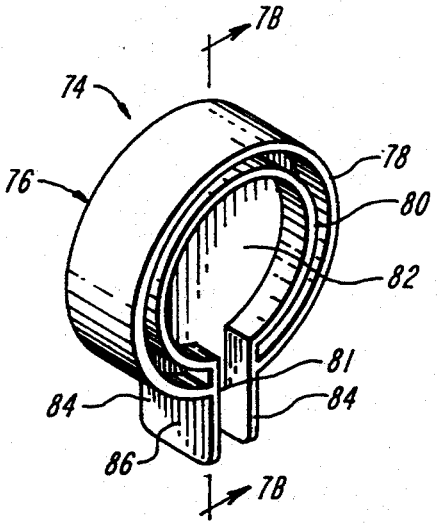
FIG. 7A is a perspective view of the retainer clip of FIG. 4.
Figure 7B:
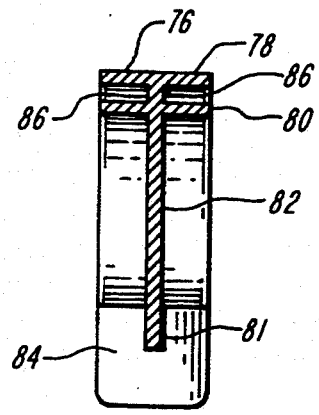
FIG. 7B is a cross-sectional view of the retainer clip of FIG. 7A taken along line 7B—7B.

The retainer clip 74 of the present invention includes a circular main body 76 having concentric outer and inner rings 78 and 80, respectively, a substantially flat dividing wall 82 having a downwardly extending exposed portion 81, and a set of radially outwardly extending fingers 84,84, as shown in FIGS. 4, 7A and 7B. The inner ring 80, in combination with the outer ring 78 and the dividing wall 82, form a sleeve-receiving channel 86 for seating the inner end 66 of the sleeve 60.

The pet door assembly 20 of the present invention further includes a bidirectional locking assembly 105, mounted in the bottom of the frame assembly 30. The locking assembly 105 includes a locking lever 110 and a locking plate 130, as shown in FIGS. 1 and 9–11. The locking lever 110 mounts within a lever housing 120 integrally formed along the bottom of the front and rear frame members 22 and 24. The lever 110 includes a handle 112, a substantially X-shaped shaft 114, and a substantially cylindrical end portion 116. The locking plate 130 has a substantially flat first end 132 and a substantially semi-circular second end 134. The plate 130 further includes an eccentric X-shaped aperture 136 that is complementary in shape to the lever shaft 114. The locking plate 130 is preferably mounted in a preformed channel 140 transversely formed in a distal end of the lever housing 120 of the front frame element 22 (see FIG. 9). The plate second end 134 seats within the channel 140. The semi-circular shape of the plate second end 134 provides sufficient clearance within the channel 140 to allow the lever 110 to rotate the locking plate 130 therein. A spring member 141, shown in cross-section in FIG. 9, but not otherwise shown in detail, retains and provides indexing for the locking plate 130.

The location of the channel 140 dictates whether the locking assembly 105 is preventing egress or ingress into the enclosure. By way of example, if it is desired, to prevent a pet from entering the enclosure, the channel 140 can be formed in the lever housing 120 at a location axially spaced before the flap 26 (to the left in FIG. 9) and in front of web 99 (see FIG. 2), which is formed along the bottom of the frame assembly 30. Alternatively, if it is desired to prevent a pet from exiting the enclosure, the channel 140 can be formed in the lever housing 120 at a location axially spaced alter the flap 26 (to the right in FIG. 9) and behind the web 99 (see FIG. 2). In a preferred embodiment of the invention, the frame assembly 30 has formed thereon a pair of lever housings 120, each mounting a locking lever 110 and a locking plate 130, and having formed therein a channel 140 located both before and after the web 99.

The lever shaft 114 and the aperture 136 of the locking plate 130 are similarly configured, so as to allow the lever to rotate the locking plate in a selected direction. The locking lever 110, when matingly coupled with the locking plate 130, alternately moves the plate between a locked and an unlocked position by rotating the handle 112, and hence the shaft 114. According to a preferred practice of the invention, FIGS. 1–3 and 9 show one of the locking mechanisms 106 of the present invention disposed in the locked position. In this position, the handle is preferably horizontally disposed, and the flat end of the locking plate 132 extends vertically upward. Conversely, the same locking mechanism can be disposed in the unlocked position by rotating the handle 112 in a clockwise direction. When disposed in this position, the locking plate flat end 132 is horizontally disposed, and the handle 112 extends vertically downward. Likewise, rotating the handle of the other locking mechanism 106 in a clockwise direction biases the mechanism in the locked position, and rotating the handle in a counter-clockwise direction biases the mechanism in the unlocked position. As described above, the illustrated locking mechanism 106 prevents egress out of the enclosure, and the locking mechanism 105 prevents ingress into the enclosure.

Figure 14A:
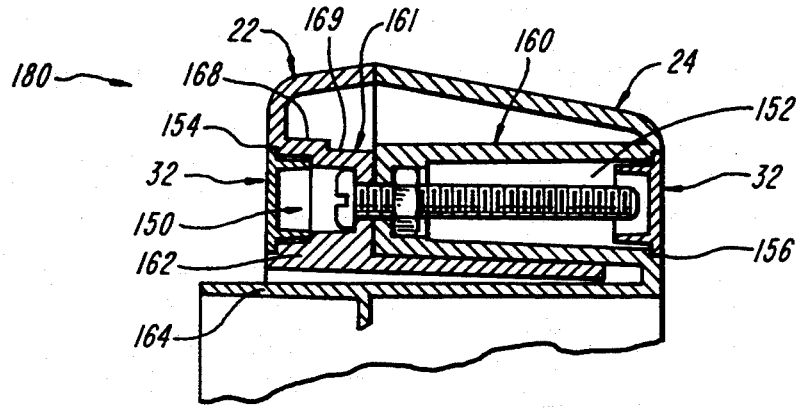
FIG. 14A is cross-sectional view of the pet door of FIG. 2 taken along line 14A—14A depicting the hidden frame securing means of the present invention with the frame disposed in the most retracted position.
Figure 14B:
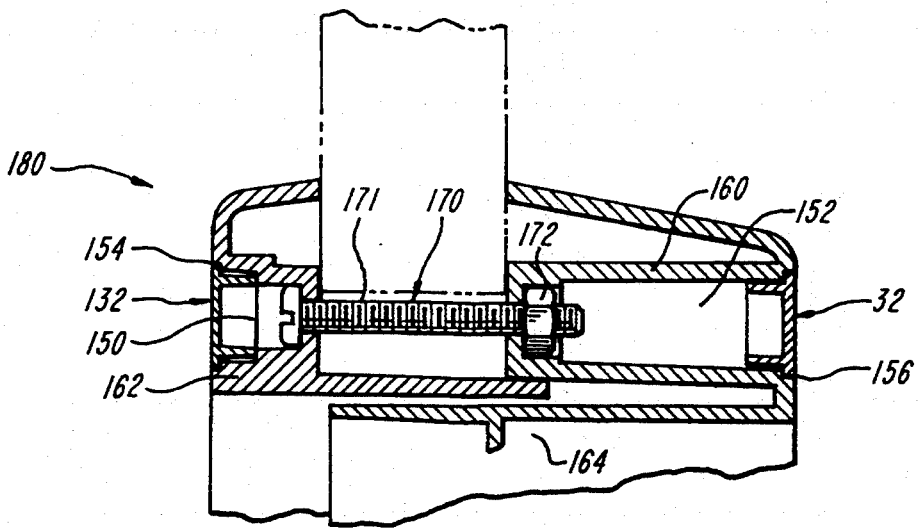
FIG. 14B is a cross-sectional view of the pet door of FIG. 2 depicting the hidden frame securing means of the present invention with the frame disposed in an expanded position.

FIGS. 14A and 14B show the frame securing assembly 180 according to a preferred embodiment of the invention. The front frame member 22 has formed therein a first fastener-receiving aperture 150, and the rear frame member 24 has formed there on a second fastener receiving aperture 152, both being aligned and at the same vertical location relative to each other. The front frame member 22 has axially extending from a rear surface a first cylindrical aperture housing 161 having integrally formed and axially spaced stepped surfaces 168 and 169, respectively. The aperture 150 extends through the frame member 22 and the cylindrical housing 161. Likewise, the rear frame member 24 has formed on a rear surface a second cylindrical aperture housing 160 that axially extends therefrom. The second aperture 152 also extends completely through the housing 160.

The front frame member 22 has an outwardly extending flange extension 162 that is integrally formed on the rear surface. Similarly, the rear frame member 24 has an outwardly extending flange extension 164 that is integrally formed on the rear surface. In a preferred embodiment, the dimensions of the front frame flange 162 are slightly greater than the dimensions of the rear frame flange 164, thereby allowing the flanges to be interdigitated, as shown. This interdigitated configuration allows the frame members 22,24 to telescopically fit within a variety of doors.

Figure 8:
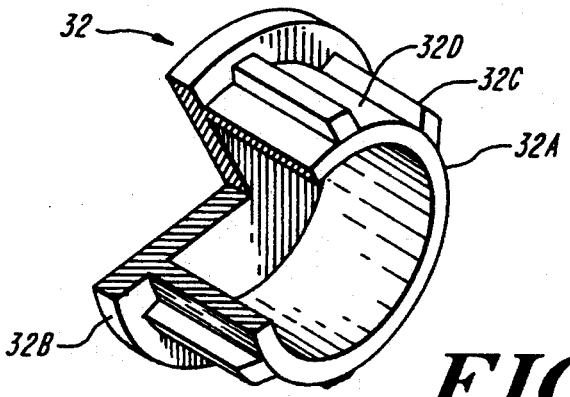
FIG. 8 is a partly cut away perspective view of a fastener cap of FIG. 2 according to a preferred embodiment of the invention.
Figure 9:
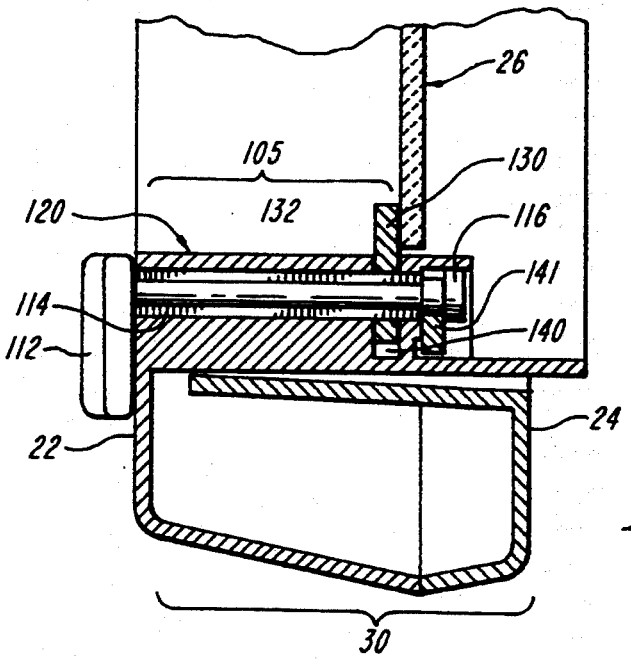
FIG. 9 is a cross-sectional view of the pet door of FIG. 2 taken along line 9—9.
Figure 10:
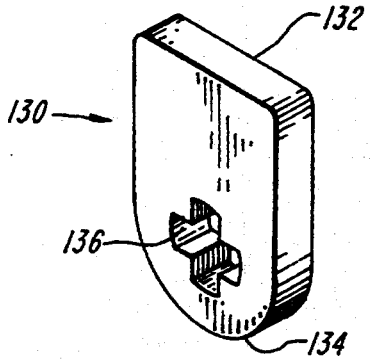
FIG. 10 is a perspective view of the locking plate according to a preferred embodiment of the invention.
Figure 11:
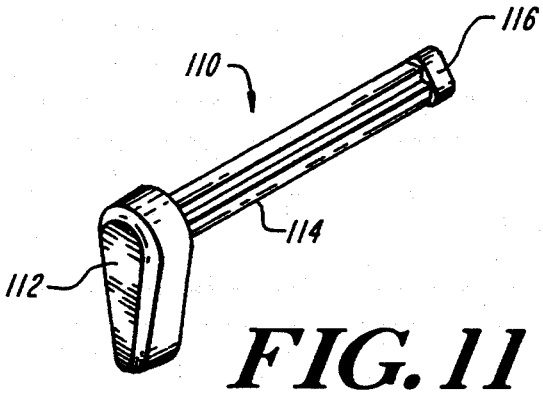
FIG. 11 is a perspective view of the locking lever according to a preferred embodiment of the invention.

The fastener-receiving apertures 150 and 152 preferably mount a screw and nut assembly. The screw 171 is preferably inserted through the first fastener-receiving aperture 150 formed in the housing 161 of the front tame member 22, and extends into the second aperture 152 formed in the housing 160 of the rear frame member 24. The surface openings 154 and 156 of the first and second apertures, respectively, have inserted therein a screw cap 32 (FIG. 8). This arrangement of employing a recessed aperture in both frame members provides a hidden screw arrangement regardless of the relative position of the flanges 162 and 164, while securing the two frame members 22, 24 together. For example, FIG. 14A shows the frame assembly 30 with the flange members 162,164 in a retracted position, i.e., narrowest width. In this position, the screwy 171 is completely enclosed within the frame members 22, 24 and hidden from view by the screw caps 32. FIG. 14B shows the frame in an extended position. In this position, the screw 170 and nut 172 capture and secure both frame members 22,24. Even in the extended position, the frame members 22,24 and the flanges 162,164 shield the screw and nut assembly. The telescoping width of the frame assembly is preferably in the range of about 0 inch to about 2 inches.

As shown in FIG. 8, the screw cap 32 has a cylindrical main body 32A that extends from a screw head 32B. The screw body 32A has a number of radially extending longitudinal protrusions 32C formed along the periphery 32D of the main body 32A. The protrusions 32C positively maintain the screw cap 32 within the fastener-receiving apertures 150 and 152.

The flap top assembly 28 can be assembled by aligning the fingers 84, 84 of the retainer clip 74 with the flap groove 36, and then inserting the exposed portion of the clip dividing wall 83 located between the fingers 84,84 into the groove 36. The fingers 84, 84 slidingly engage with the flap front and rear surfaces 25 and 27, respectively, until the dividing wall exposed surface 83 abuts an end 35 of the flap groove 36.

The axial groove 62 of the sleeve 60 is then aligned with the follower element 34 and with the top of the flap 26. The follower element 34 is placed into the sleeve inner end 66, and the groove 62 slidingly engages with the flap front and rear surfaces 25,27 until the end 65 of the axial groove 62 abuts the flap sidewall 29. The collar 68 is then inserted into the sleeve-receiving channel 86 formed in the retainer clip 74. Likewise, the opposite follower element 34 is inserted into the other sleeve 60, and the collar 68 of that sleeve 60 also seats in a corresponding sleeve-receiving channel 86 formed in the retainer clip 74.

Figure 12A:
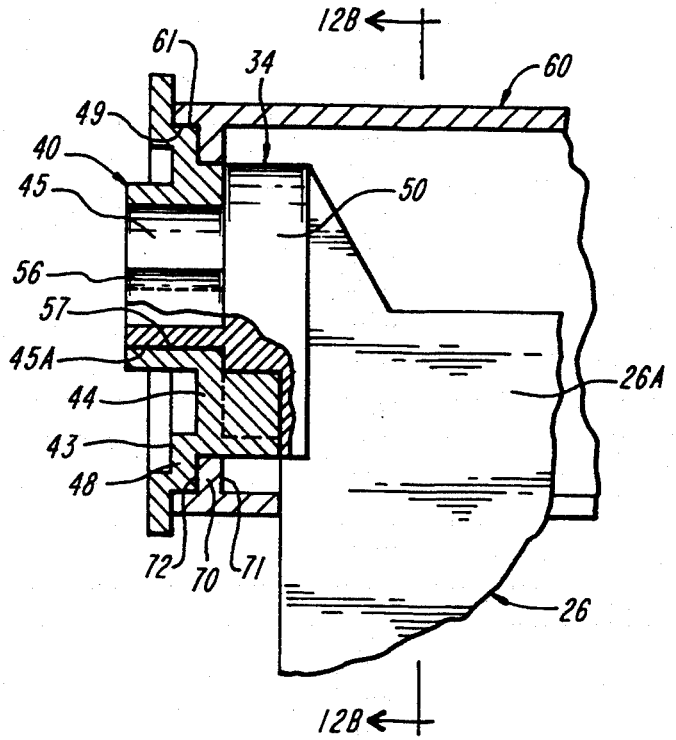
FIG. 12A is a cross-sectional view of the camming mechanism of FIG. 2 taken along line 12A—12A with the door flap disposed in a vertical position.
Figure 12B:
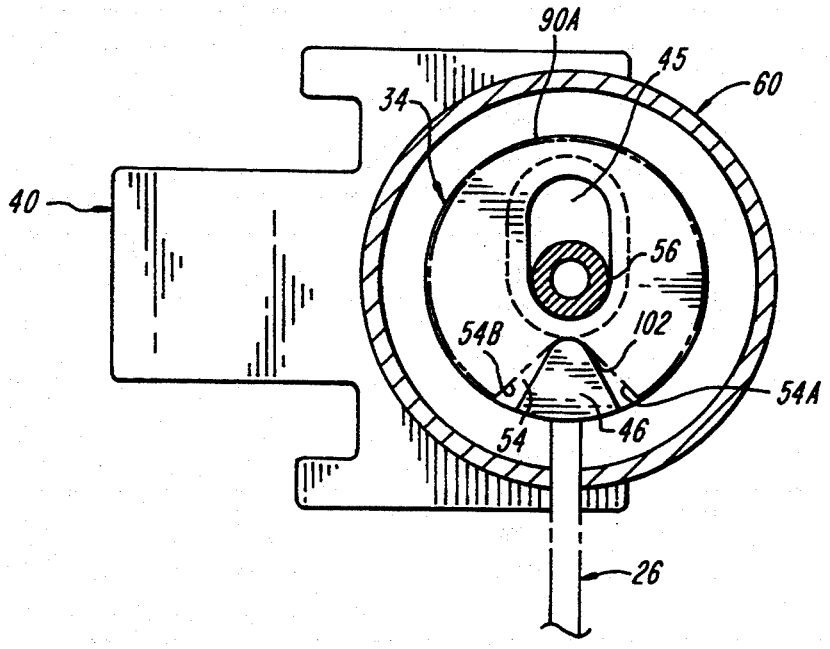
FIG. 12B is a cross-sectional view of the camming mechanism of FIG. 12A taken along line 12B—12B with the door flap disposed in a vertical position.

Each stationary cam element 40 mounts in the frame mounting groove 38 by sliding the cam element 40 into the groove until the cam element stop tab 47 abuts a corresponding tab formed in the frame grove 38. Once mounted, the assembled flap top assembly is mountingly supported in the frame by seating the wedge-shaped groove 54 of the follower element over the wedge-shaped protrusion 46 of the stationary cam element 40. As shown in FIGS. 12A and 12B, when seated in this position, the front face 72 of the flange 70 abuts the first stepped surface 43 of the mounting portion 48. Additionally, the sleeve outer end 69 contacts the cam element front face 42, and the bottom portion 57 of the circular protrusion 56 abuts a bottom portion 45A of the through bore 45.

The camming feature of the present invention operates as follows. When the flap 26 is disposed in its normally vertical position (FIGS. 1–3), exemplified by being disposed in a first or lowest vertical position 90A, the apex 102 of the wedge-shaped groove 54 contacts the apex 100 of the wedge-shaped protrusion 46, as shown in FIG. 12B. In this orientation, the circular protrusion 56 seats in the bottom 57 of the through-bore 45, placing the flap 26 in sealing contact with the sides 92, 92 and the bottom 94 of the frame assembly 30.

Figure 13A:
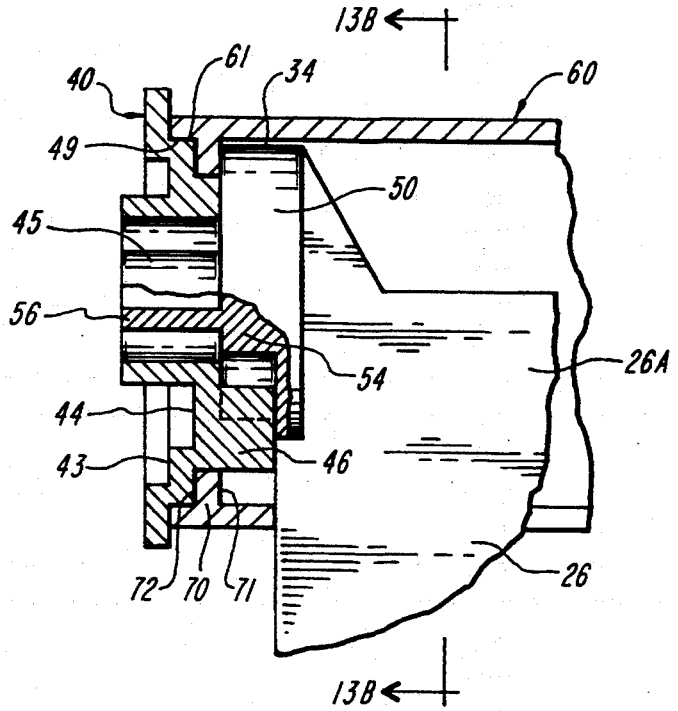
FIG. 13A is a cross-sectional view of the camming mechanism of FIG. 2 taken along line 12A—12A with the door flap displaced from a vertical position.
Figure 13B:
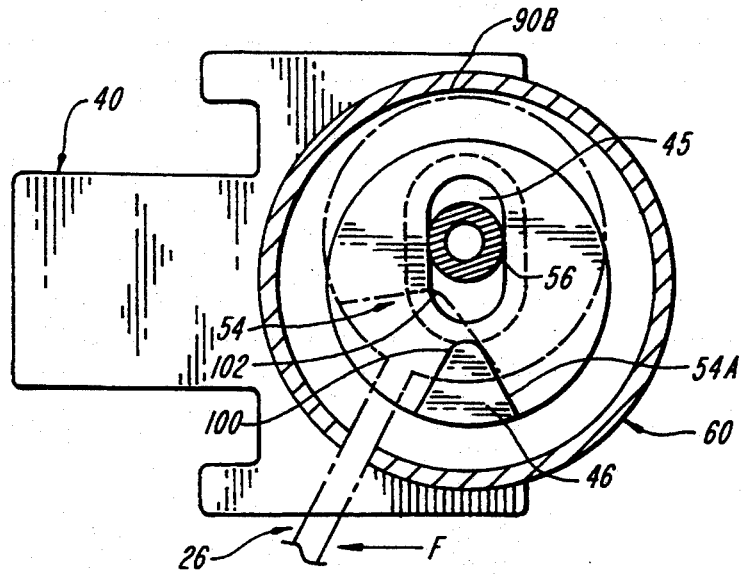
FIG. 13B is a side exploded view of the camming mechanism of FIG. 13A taken along line 13B—13B with the door flap displaced from the vertical position.

When a transverse force F is applied to the flap 26 in a particular direction, as by the movement of a pet through the pet door 20, the flap 26 pivotally moves in that direction away from the normally vertical position, as shown in FIGS. 13A and 13B. This movement places the side 54A of the follower element groove 54 in intimate facing contact with the respective slanted side of the protrusion 46. As the pet continues through the door, this externally applied force biases the follower element 34 up the slanted side of the stationary protrusion 46, lifting the flap top portion assembly 28 vertically upward. The assembly 28 moves in the vertical direction since the follower element protrusion 56 slidingly moves vertically upward in the elliptical through bore 45. FIG. 13B shows the position 90B (shown in phantom) of the follower element 34 and of the circular protrusion 56 in the through bore 45 during this axial movement. The vertically upward movement of the flap top assembly 28 lifts the flap upwardly and away from the frame assembly 30, breaking the airtight and weathertight seal and allowing the pet to exit or enter the enclosure. Those of ordinary skill will recognize that although the groove angle as depicted in FIG. 13B is greater than the wedge-shaped protrusion angle, the angles of the groove and the protrusion can be equal.

When the transverse force F applied to the pet door flap 26 is eliminated, the follower groove 54 slides downwardly on the slanted side of the stationary protrusion 46. Consequently, the cylindrical protrusion of the follower element 34 moves vertically downward in the through bore 45, returning the flap 26 to its normally vertical position (see FIGS. 12A and 12B). As the flap returns to its normal position, the tapered inner surface of the frame assembly 30 seats the flap 26 in the frame assembly 30, thereby reforming the weathertight seal.

It will thus be seen that the invention efficiently attains the objects set forth above, among those made apparent from the preceding description. Since certain changes may be made in the above construction without departing from the scope of the invention, it is intended that all matter contained in the above description or shown in the accompanying drawings be interpreted as illustrative and not in a limiting sense.

It is also to be understood that the following claims are to cover all generic and specific features of the invention described herein, and all statements of the scope of the invention which, as a matter of language, might be said to fall therebetween.

Having described the invention, what is claimed as new and desired to be secured by Letters Patent is:

1. A pet door apparatus for allowing animals to enter and exit an enclosure, said apparatus comprising frame means defining an opening in said apparatus, and including a top frame portion, flap means suspended in said frame means, for closing said opening, said flap means including a pivotable flap having a top portion and extending, in a first orientation, generally vertically downwardly from said top portion, said flap top portion including horizontally extending pivot means, arranged in said top frame portion for pivotably moving said flap in response to horizontal force on said flap by an animal, and at least one of said top frame portion and said flap top portion including camming means arranged for vertically moving said flap top portion upwardly relative to said top frame portion during pivotal movement of said flap away from said generally vertical position.

2. The pet door apparatus according to claim 1 wherein said opening has a wider top and tapers to a narrower bottom, and said flap is correspondingly tapered to seat said flap within said frame means.

3. The pet door apparatus according to claim 1 comprising locking means coupled to said frame means for preventing said flap from moving in a selected direction substantially transverse to said general vertical position.

4. The pet door apparatus of claim 3 wherein said locking means comprises exit locking means for preventing movement of said flap in a scheduled direction for preventing an animal from exiting said enclosure through said pet door, and enter locking means, independent of said exit locking means, for preventing movement of said flap in a selected direction for preventing said animal from entering said enclosure through said door.

5. The pet door apparatus of claim 3 wherein said locking means comprises a locking lever having a main body having a first end and a chamfered second end, and a handle portion integrally formed with said main body first end, and a locking plate having an eccentric chamfered through bore that is substantially complementary in configuration to said locking lever chamfered second end, whereby said locking plate is movable between a locked position and an unlocked position by rotating said locking lever in a predetermined direction.

6. A pet door apparatus allowing animals to enter and exit an enclosure, said apparatus comprising frame means including sidewalls defining an opening in said apparatus, flap means suspended in said frame means for closing said opening defined in said apparatus, said flap means including a pivotable flap having a top portion and extending, in a first orientation, generally vertically downward, said flap top portion having horizontally extending pivot means, including a rotatable horizontal axial portion having at either end a follower element, for pivotably moving said flap, and said frame means including camming means for vertically moving said horizontal axial portion during pivotal movement of said flap away from said vertical position, said camming means includes a camming assembly defining an aperture, and means forming a cam protrusion, said follower element further defining a slot complementary in location and configuration to said cam protrusion, for camming engagement between said follower element and said cam protrusion, and extension means concentrically disposed on said follower element and extending outwardly therefrom, for insertion within said aperture.

7. The pet door according to claim 6 wherein said opening has a wider top and tapers to a narrower bottom, and said flap is correspondingly tapered to seat said flap within said sidewalls of said frame means.

8. The pet door of claim 6 wherein said aperture is elliptical in shape, and said cam protrusion is disposed below said aperture, in said first orientation.

9. The pet door according to claim 6 comprising locking means coupled to said frame means for selectively preventing said flap from moving in a selected direction substantially transverse to said general vertical position.

10. The pet door of claim 9 wherein said locking means comprises exit locking means for preventing an animal from exiting said enclosure through said pet door while simultaneously allowing said animal to enter said enclosure through said door, and enter locking means for preventing said animal from entering said enclosure through said door while simultaneously allowing said animal to exit said enclosure through said door.

11. The pet door of claim 9 wherein said locking means comprises a locking lever having a main body having a first end and a chamfered second end and a handle portion integrally formed with said main body first end, and a locking plate having an eccentric chamfered through bore that is substantially complementary in configuration to said locking lever chamfered second end, whereby said locking plate is movable between a locked position and an unlocked position by rotating said locking lever in a predetermined direction.

* * * * *